US005385249A

United States Patent [19]

Long, Jr.

[11] Patent Number: 5,385,249

[45] Date of Patent: Jan. 31, 1995

[54] MATERIAL HANDLING MACHINE WITH FORCE-ISOLATING SUPPORT LINK

[75] Inventor: Herbert D. Long, Jr., West Allis, Wis.

[73] Assignee: Harnischfeger Corporation, Brookfield, Wis.

[21] Appl. No.: 98,122

[22] Filed: Jul. 27, 1993

[51] Int. Cl.[6] ..... B66C 19/00

[52] U.S. Cl. ..... 212/218; 104/126; 212/219

[58] Field of Search ..... 212/205, 218, 219, 220, 212/221, 142.1, 140, 141, 142; 104/95, 126

[56] References Cited

U.S. PATENT DOCUMENTS

| | | | |
|---|---|---|---|
| 549,851 | 11/1895 | Fryer | 104/95 |
| 945,751 | 1/1910 | Butler | 104/95 |
| 1,138,697 | 5/1915 | Smith | 104/95 |
| 1,142,124 | 6/1915 | Smith | 104/95 |
| 4,471,867 | 9/1984 | Forshee | 104/95 |
| 5,022,542 | 6/1991 | Beier | 212/219 |

FOREIGN PATENT DOCUMENTS

| | | | |
|---|---|---|---|
| 691383 | 10/1979 | U.S.S.R. | 212/218 |

*Primary Examiner*—Michael S. Huppert
*Assistant Examiner*—Thomas J. Brahan
*Attorney, Agent, or Firm*—Jansson & Shupe, Ltd.

[57] ABSTRACT

The disclosure involves a material handling machine such as a lattice-type portal crane having an elongate lattice girder suspended from a girder beam by a first and second support links. In turn, the girder beam is supported at an elevation by a pair of legs. The improvement comprises a force transfer link coupling the support links so that forces transferred between the girder beam and either leg are isolated from the girder. The girder, which is triangular-shaped, has a top apex-like chord member and a pair of lower chord members. The support links and the force transfer link support the girder at the lower chord members and the top chord member is spaced (and therefore, isolated) from the girder beam.

9 Claims, 6 Drawing Sheets

MATERIAL HANDLING MACHINE WITH FORCE-ISOLATING SUPPORT LINK

FIELD OF THE INVENTION

This invention relates generally to material handling machines and, more particularly, to such machines having traversing hoists.

BACKGROUND OF THE INVENTION

As the name suggests, material handling machines are used to move material from one place to another. Both the machines themselves and the material handled by them can take any of a wide variety of forms. For example, material handled by such machines may include excavated soil, rock, steel coils and plate, ladles of molten metal, lumber and logs. Machines for handling such material include excavators, loaders, shovels and cranes. The latter includes overhead travelling cranes, which run on elevated rails, and gantry-type cranes, "stiff-legged" structures which run on rails mounted at ground level.

While the aforementioned types of cranes come in a variety of configurations, they share some common features. One is that they both ride on rigid flanged wheels rolling atop parallel, spaced railroad-like rails. Another is that they are equipped with a traversely-movable trolley on which is mounted a load-lifting hoist apparatus. Such cranes are capable of picking up a load from a location, raising it to an elevation and transporting the load to another location. Yet another common feature is that they are capable of moving a load in any of three axes of motion, namely, travel (along the rails), trolley traverse (perpendicular to the rails) and hoist/-lower.

Gantry cranes have a generally horizontal frame arrangement supported above the ground on side supports so as to span the area beneath the frame. Gantry cranes are often referred to as portal cranes since when viewed parallel to the rails, they appear gate-like with a large opening defined by the frame structure and the side supports. A type of portal crane is shown in U.S. Pat. No. 5,022,542 (Beier).

The exemplary crane shown in the Beier patent has downwardly-extending legs, each terminating in a wheel assembly. While a wheel assembly on either side of the crane may simply be a non-driven "idler" assembly, each side of the crane has at least one wheel assembly which includes a drive motor and gearing. The operator controls movements of the crane from a control cab well above the ground.

Portal cranes are often used out-of-doors and are subjected to certain environment-related and use-related forces. An example of an environment-related force is wind loading. Wind in a direction parallel to the rails imposes forces on the crane which tend to tip the crane. In recognition of this and other factors, the support legs of portal cranes generally define a triangle with spaced-apart lower "feet" for stability. Portal cranes are often made in a lattice arrangement for, among other reasons, reducing the frontal area subjected to wind-imposed forces.

An example of a use-related force involves the control of the drive motor(s) at either side of the crane. It presents a very difficult control problem to make all motors run and brake at precisely the same rotational speed and at the same time. As a result, the crane can become slightly twisted or skewed by the motor(s) on one side driving that side slightly faster than the motor(s) on the other side.

And even if all of the motors on both sides of the crane are operated in precise synchronism, other forces are imposed on the crane by merely accelerating and decelerating it as a load is moved from one location to another. As a rough analogy, the head of an automobile driver or passenger tends to move rearward if the auto is accelerated sharply or forward if it is braked abruptly. The suspended horizontal girder structure of a portal crane experiences the same kind of forces during crane acceleration and deceleration.

Yet another example of a use-related force involves the load itself. Such load is suspended from cables which are taut but not rigid. When the crane is accelerated, the load lags slightly and tends to twist the horizontal, suspended frame about its long axis. Deceleration produces the same type of twist but in the opposite direction.

The portal crane shown in the Beier patent has a tubular top chord welded to a supporting plate. In turn, the plate is welded and bolted to a horizontal girder support beam. The upper ends of diagonal "laces" or tube members are welded to the top chord and their spaced lower ends are attached through a reinforcing, pin-attachment plate to the lower ends of support arms or links.

Forces transferring between the horizontal girder beam and the downwardly-extending legs are imposed on the welds attaching the tubular top chord and the diagonal laces to one another. Such forces are also imposed on the weld securing the top chord to its support plate and upon the bolts securing the support plate to the girder beam. And such force transfer is not only inevitable, it occurs substantially continuously when the crane is being used and, to some degree, if the crane is subjected to high wind forces, whether or not in use.

With the above-noted earlier configuration, it has been found unexpectedly that failures may occur in any one, some or all of three locations, namely, on the top chord/laces welds, on the top chord/plate weld and/or on the plate/support beam weld and bolts. A logical approach to preventing such failures would be to "beef up" and reinforce the welds, bolts and the like. However, the invention substantially eliminates these failures in a very unusual way using a unique force transfer link and a "floating" girder arrangement.

OBJECTS OF THE INVENTION

It is an object of the invention to provide a new crane structure overcoming some of the problems and shortcomings of the prior art.

Another object of the invention is to provide a new crane structure which helps eliminate broken welds and bolts.

Another object of the invention is to provide a new crane structure which substantially isolates from the girder the forces transferred between the girder beam and attached support legs. How these and other objects are accomplished will become apparent from the following descriptions and from the drawing.

SUMMARY OF THE INVENTION

The invention involves an improvement in a material handling machine such as a gantry-type portal crane. Such crane has an elongate lattice girder suspended from a girder beam by first and second support links. In turn, the girder beam is supported at an elevation above the ground by a pair of stilt-like legs supported by flanged wheels riding on rails. The improvement comprises a force transfer link coupling the support links so that forces transferred between the girder beam and either leg are isolated from the girder.

More specifically, each support link has an upper end attached to the girder beam and a lower end attached to the girder. The force transfer link extends between the upper end of the first support link and the lower end of the second support link. In the preferred embodiment, the first support link, the force transfer link and the girder form a triangle as do the second support link, the force transfer link and the girder.

In another aspect of the invention, the girder is generally triangular and has a top apex chord member, a first lower chord member and a second lower chord member which generally define the corners of the triangle. Unlike the earlier configuration depicted in the Beier patent, the apex chord member is spaced from the girder beam and therefore "floats" with respect to such girder beam. The girder itself is mounted by what might be termed a two-point suspension system rather than a three-point suspension system. That is, the girder is supported substantially entirely by the support links and the force transfer link, all of which are attached near the lower "corners" of the girder. The apex chord member is free to move with respect to the girder beam.

In yet another aspect of the invention, the apex chord member is fabricated and has a box-like cross-section and the girder includes tube-like lace members attached to the apex chord member. Attachment is in a cluster area; in other words, the ends of the lace members are grouped together in a cluster when attached, preferably by welding. To further strengthen the girder, the chord member is internally braced by reinforcing plates at the cluster area.

Further details of the invention are set forth in the following detailed description and in the drawing.

DETAILED DESCRIPTION OF PREFERRED EMBODIMENTS

Aspects of the invention, including the force transfer link 10, are described in connection with a portal crane 11. Before describing the invention, a general description of such a crane 11 is set forth.

Figure 1:
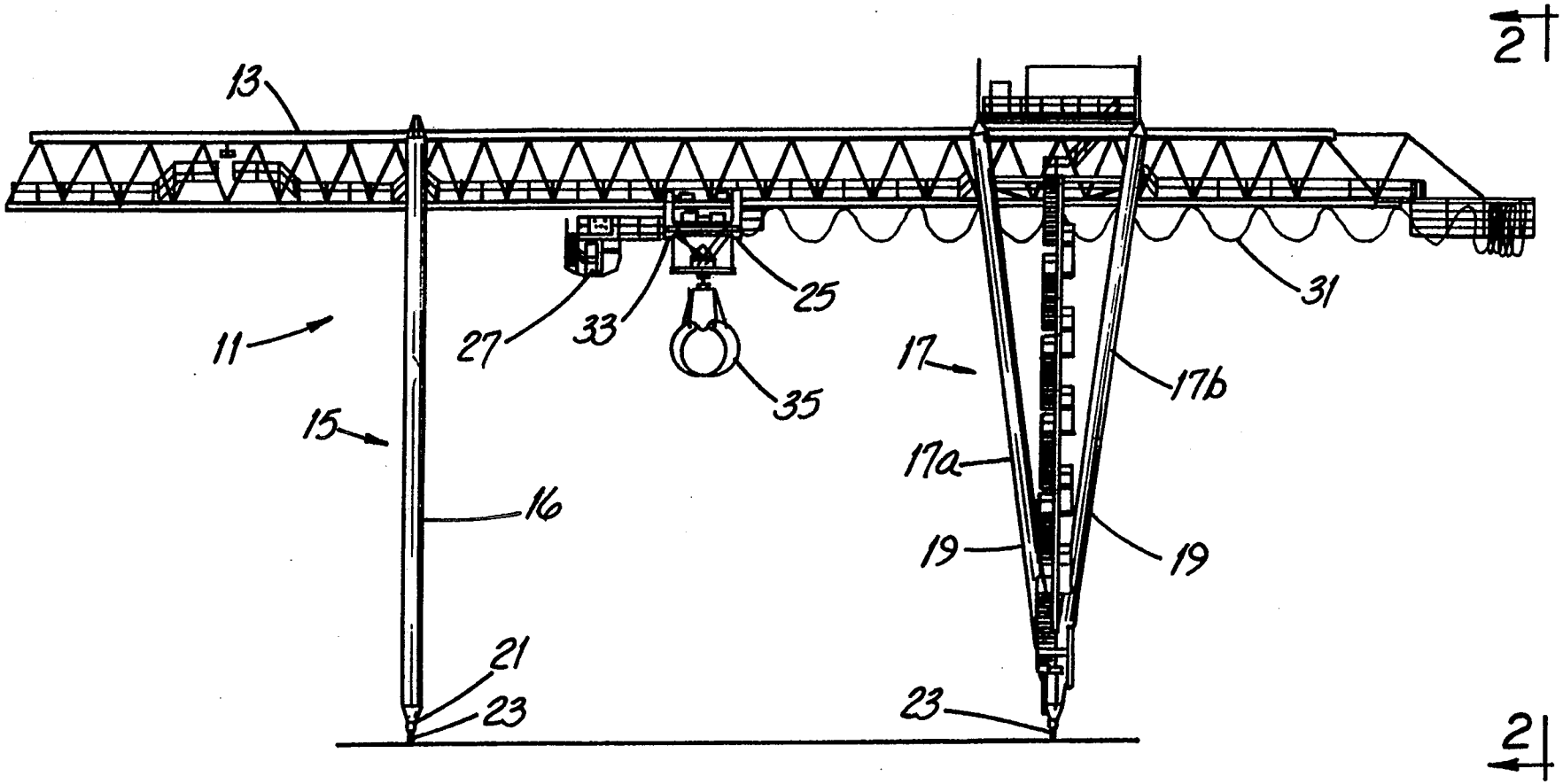
FIG. 1 is a side elevation view of a portal crane of the type incorporating the invention.
Figure 2:
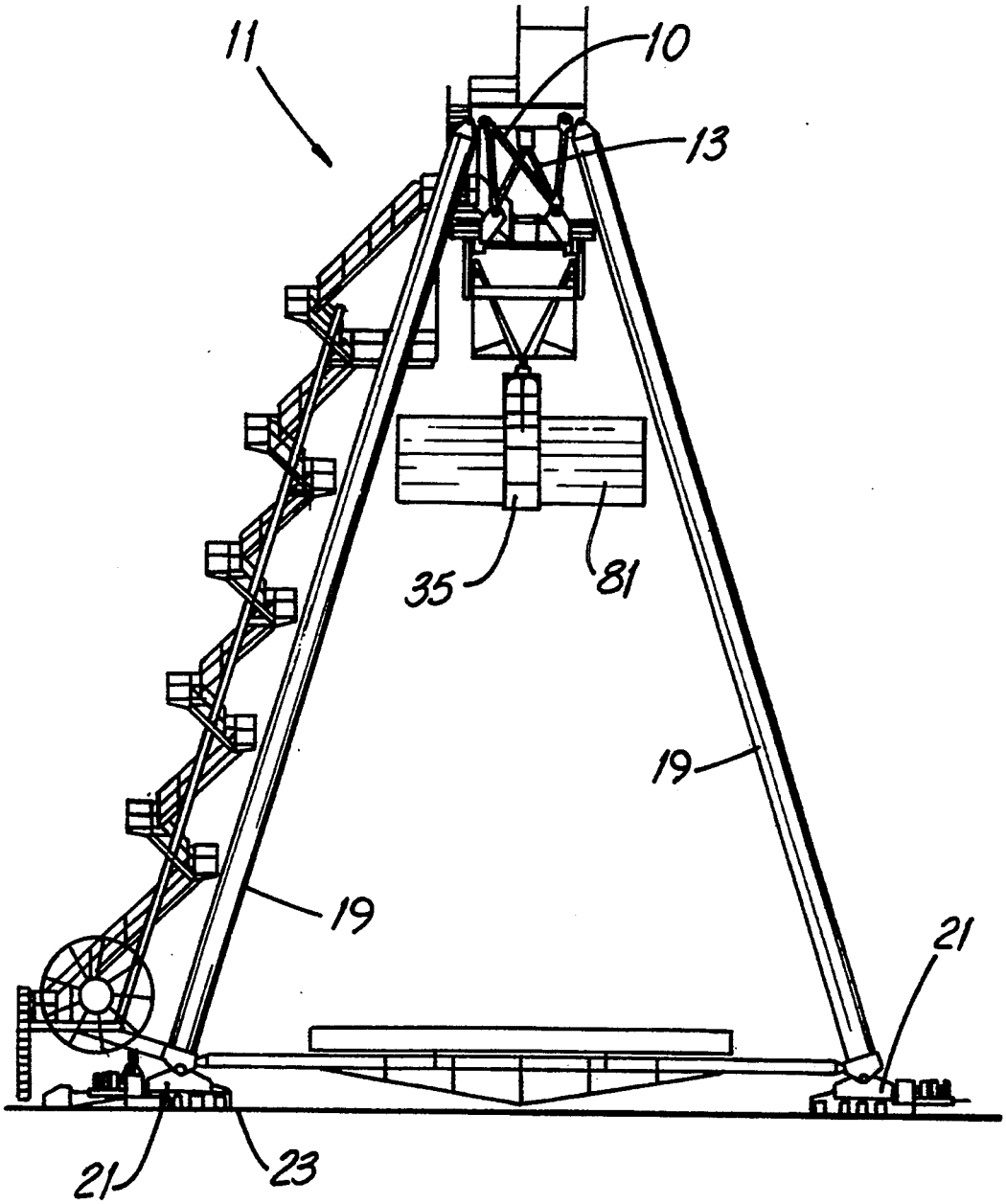
FIG. 2 is an end elevation view of the crane of FIG. 1 taken along the viewing plane 2—2 thereof.
Figure 3:
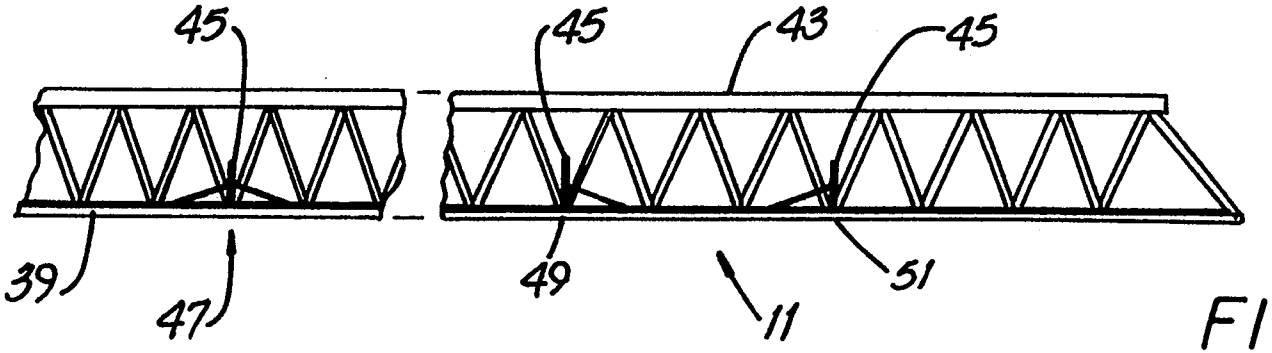
FIG. 3 is a side elevation view of the girder used on the crane of FIG. 1.

Referring first to FIGS. 1-3, the portal crane 11 includes a horizontal, elongate girder 13 supported nearer one end by an inverted V-shaped hinged leg 15 (actually, two leg members 16 with their "feet" spread apart). Nearer its other end, the girder 13 is supported by what is known as a fixed leg 17 which includes two inverted V-shaped legs **17*a*, 17*b*, each with two similarly-arranged leg members 19. The fixed leg 17 is so named because it resists moment forces tending to collapse the crane 11 to the left or right as viewed in FIG. 1**.

At their lower ends, the leg members 16, 19 are supported by wheel assemblies 21 which ride atop parallel, spaced-apart rails 23 mounted substantially at ground level. In the view of FIG. 1, the rails 23 extend into and out of the sheet while in that of FIG. 2, they are coincident with or parallel to the sheet. At least one wheel assembly 21 on the hinged leg 15 and another on the fixed leg 17 is powered by a drive motor for moving the crane 11 along the rails 23.

Figure 4:
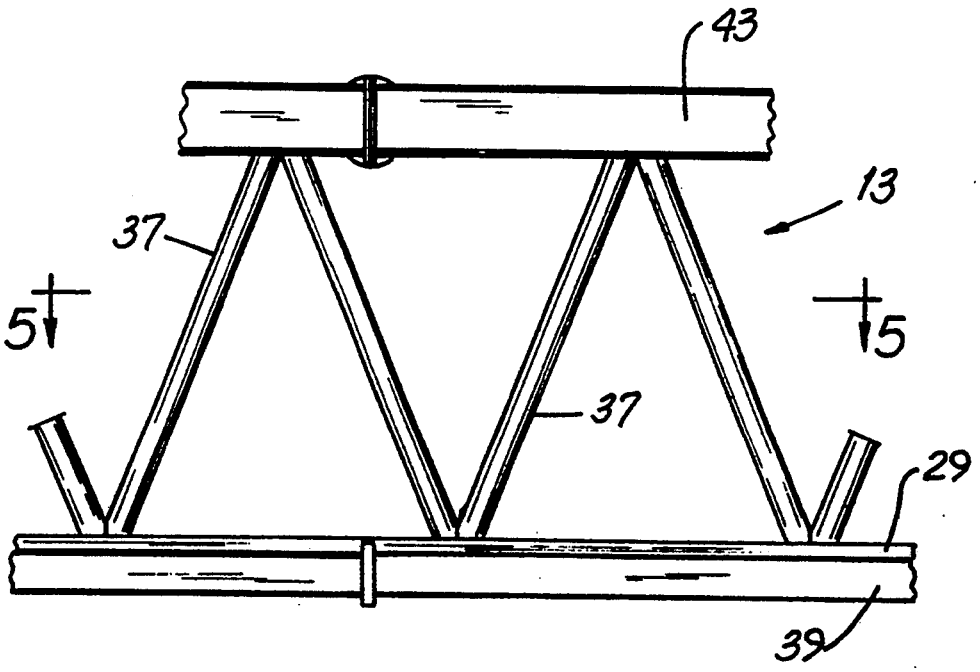
FIG. 4 is an enlarged elevation view of a portion of the girder shown in FIG. 3.
Figure 5:
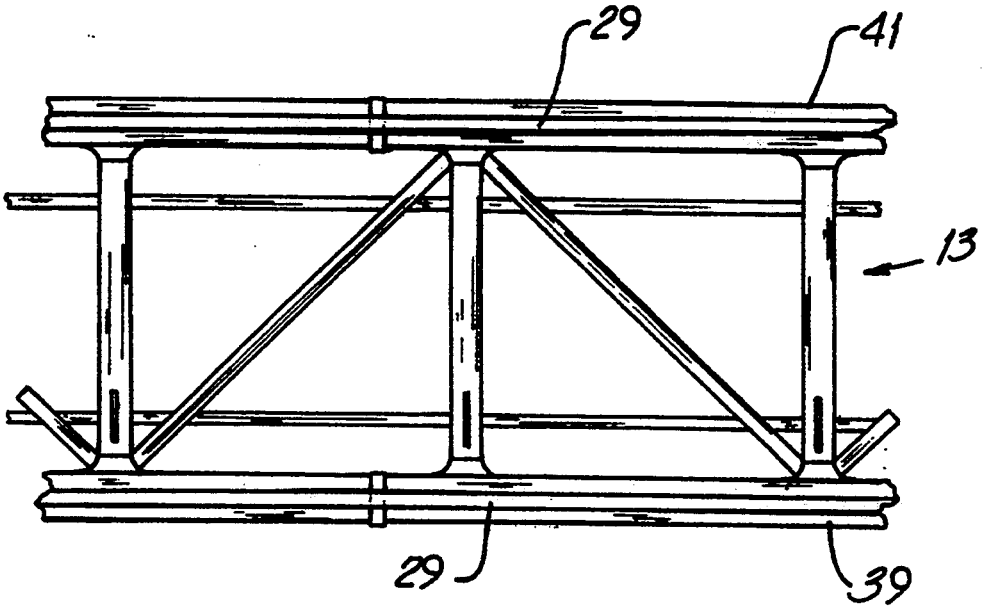
FIG. 5 is a top section view of the girder portion shown in FIG. 4 taken along the viewing plane 5—5 thereof. Parts, i.e., girder "laces" are omitted.

Referring also to FIGS. 4 and 5, a motorized trolley 25 and operator's cab 27 are suspended beneath the girder 13 by hook-like supports, the upper portions of which ride on rails 29 mounted on the girder 13. Power and control wiring is connected to the cab 27 by a festooned cable 31. The trolley 25 has a load-lifting hoist apparatus 33 attached by wire rope to a claw-like grapple 35. A grapple 35 is ideally suited for handling long stick-like material such as logs but, of course, a bucket, hook, magnet or the like could be used in place of the grapple 35 for handling other types of material.

From the foregoing, it is apparent that the operator can move the crane 11 in the travel direction (left and right in FIG. 2 and can also move the trolley 25 in the traverse direction, left and right in FIG. 1. To give some idea of scale, the girder 13 of the exemplary portal crane 11 is about 260 feet long and is suspended more than 100 feet above the ground. The leading manufacturer of portal cranes is Harnischfeger Corporation of Milwaukee, Wis., U.S.A.

Referring further to FIGS. 4 and 5, exemplary portions of the girder 13 are illustrated to show its lattice-like construction. In such construction, certain pipe-like components are called "laces 37." The girder 13 has first and second lower chords 39 and 41, respectively, embodied as I-beams. Each chord 39, 41 has a trolley rail 29 mounted atop it so that the trolley 25 can roll along and traverse substantially the entire length of the girder 13. The laces 37 (which are omitted from FIG. 5) are inclined both inwardly and traversely, the latter toward one end or the other of the girder 13. At their upper ends, each lace 37 is attached to the top chord member 43 which extends "spine-like" along substantially the entire length of the girder 13. At their lower ends, the laces are attached to one or the other of the lower chords 39 or 41.

In FIG. 3, it will be noted that the girder 13 also includes several upstanding pin attachment plates 45. In the exemplary embodiment, there are six such plates, two plates (one behind the other) at the location 47 which are used to suspend the girder from the hinged leg. At the locations 49 and 51, there are four more plates 45 (two at each location 49 and 51) which are used to suspend the girder 13 from the fixed leg 17.

Figure 6:
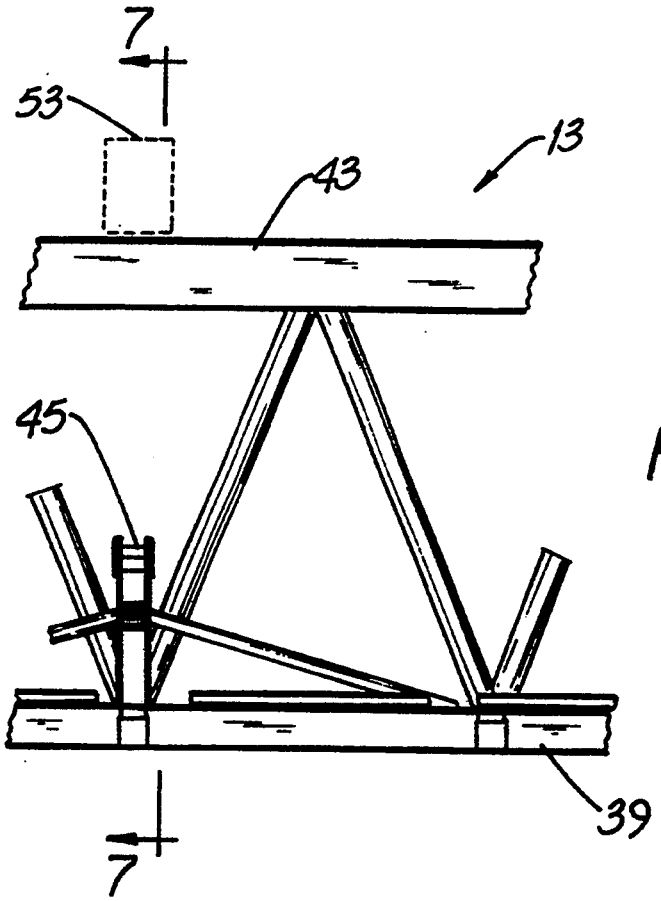
FIG. 6 is an enlarged view of a portion of the girder of FIG. 3 showing a pin attachment plate. Parts are broken away.
Figure 7:
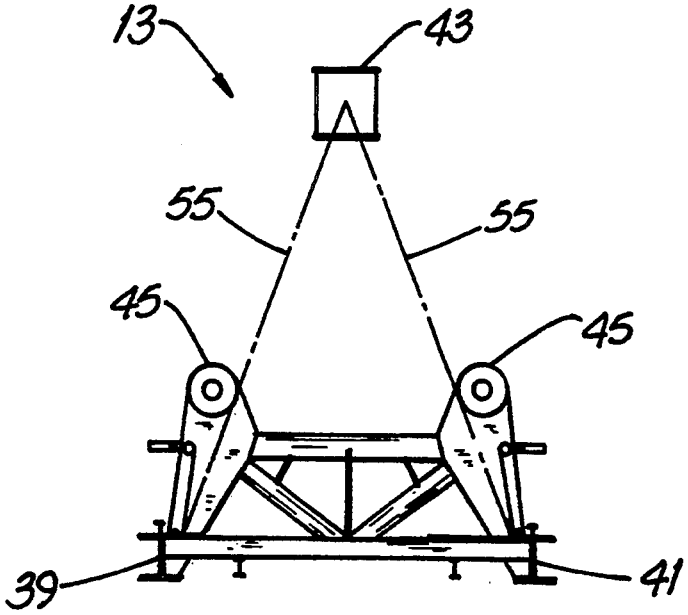
FIG. 7 is a view of the girder portion of FIG. 6 taken along the viewing plane 7—7 thereof.

FIGS. 6 and 7 show aspects of the girder 13 in greater detail. FIG. 6 shows a pin attachment plate 45, the first lower chord 39 and the top chord member 43 with the girder beam 53 shown in dashed outline. FIG. 7 shows the lower chords 39 and 41, the top chord member 43 and two pin attachment plates 45. The center lines 55 of laces 37 are also shown.

Figure 8:
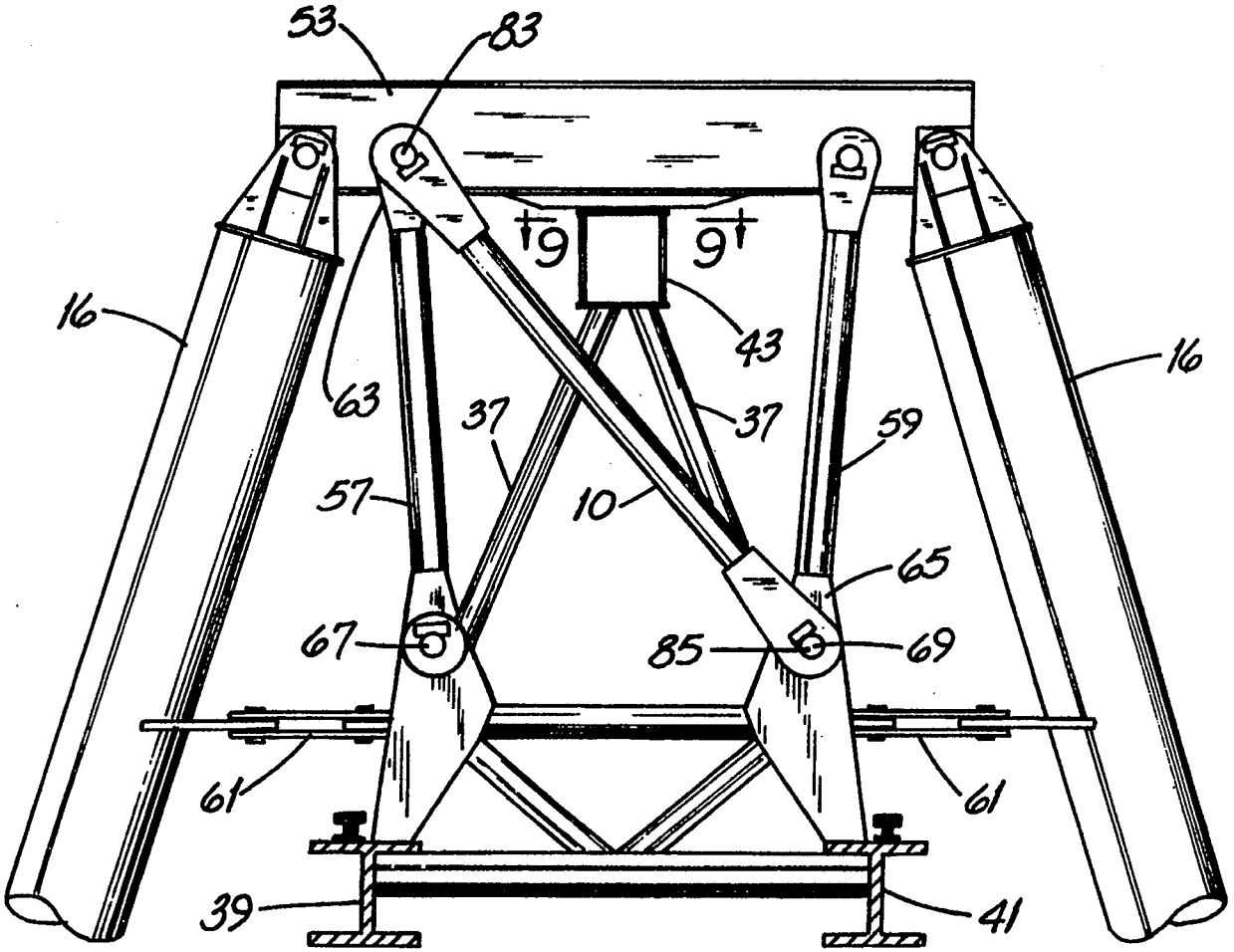
FIG. 8 is an enlarged view of the top portion of the view of FIG. 2.

Referring now to FIG. 8, details of one of the locations 47, 49 or 51 will now be described. The lattice girder 13 is suspended from a girder beam 53 by elongate bar-like first and second support links 57 and 59, respectively, each of which is pinned at its upper end to the girder beam 53. At its lower end, each support link 57, 59 is pinned to a separate pin attachment plate 45. An angularly, downward-depending leg member 16 (or 19) is pinned to each outer end of the beam 53 and as shown in FIG. 1 or 2, such leg members 16, 19 extend to the wheel assemblies 21 and support the girder 13. For added rigidity, a horizontal bracing link 61 is connected between each leg member 16, 19 and its adjacent pin attachment plate 45.

A rigid, substantially straight, elongate force transfer link 10 couples the upper end 63 of the first support link 57 and the lower end 65 of the second support link 59 so that forces transferred between the girder beam 53 and a leg member 16, 19 are isolated from the girder 13. In the preferred embodiment, the first support link 57, the force transfer link 10 and the girder 13 form a triangle with its apex at the beam 53. Similarly, the second support link 59, the force transfer link 10 and the girder 13 also form a triangle with its apex at a pin attachment plate 45.

In another aspect of the invention, the top apex chord member 43 and the lower chords 39, 41 also define the corners of a triangle but, unlike the earlier configuration depicted in the Beier patent, the apex chord member 43 is spaced from the girder beam 53. Such chord member 43 therefore "floats" with respect to the girder beam 53 and the beam 53 and the member 43 are free to move with respect to one another. While there is not a great deal of relative movement, efforts to resist such movement in the earlier design led to weld and bolt fractures.

Considered another way, the girder 13 itself is mounted by what might be termed a two-point suspension system—it is suspended at points 67 and 69 solely by the support links 57, 59 and by the pin attachment plates 45. This is in sharp contrast to the earlier three-point suspension system. That is, the girder 13 is supported substantially entirely by the support links 57, 59 and the force transfer link 10, all of which are attached near the lower "corners" of the girder 13.

Figure 9:
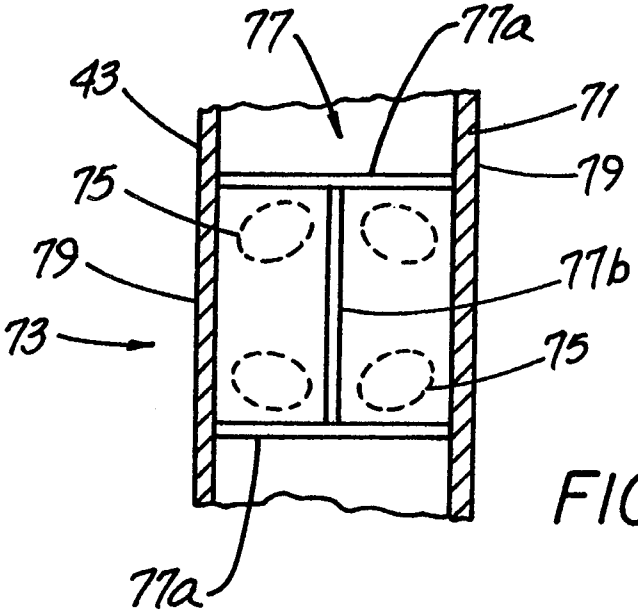
FIG. 9 is a top plan view, in cross-section, showing the interior of the top chord member of a portal crane.

Referring also to FIG. 9, in yet another aspect of the invention, the apex chord member 43 is fabricated from steel plate 71 and has a rectangular, box-like cross-section. The laces 37 are attached to the apex chord member 43 in a cluster area 73 in that the upper ends 75 of the laces 37, which are welded to the underside of the chord member 43, are grouped together in a cluster when attached, preferably by welding.

To further strengthen the girder 13, the chord member 43 is internally braced by reinforcing plates 77 at the cluster area 73. There are two outer plates **77*a* which extend laterally across the chord member 43 and each plate 77*a* is attached to each side panel 79. The outer plates 77*a* are located so as to "confine" the lace/chord member welded attachment points between the plates 77*a* and the member side panels 79. There is also a center plate 77*b* extending between and joining the outer plates 77*a* and the location of the center plate 77*b* is such that one-half of the attachment points are to either side of the plate 77*b***.

Some details of operation will now be set forth and a single example will help illustrate the unique features of the invention. Understanding of this example will be aided by a rudimentary understanding of the field of engineering mechanics and, particularly, of statics and dynamics.

Referring again to FIGS. 1, 2 and 8, it is assumed that a load 81 is suspended from the crane 11 by the grapple 35. It is also assumed that for whatever reason (rapid deceleration or the like), such load 81 swings to the right in FIGS. 2 and 8, i.e., away from the viewer of FIG. 1.

The forces resulting from such swinging movement tend to stretch the first support link 57, compress the second support link 59 and momentarily reduce the downward load on the right-side leg member 16 shown in FIG. 8. However, the force transfer link 10 helps prevent either eventuality and, particularly, prevents such forces from "transferring" to the laces 37 and thence to the top chord member 43.

Rather, the force transfer link 10 transfers forces between its upper attachment point 83 on the beam 53 and its lower attachment point 85 at the lower end 65 of the second support link 59. Thus, there is no significant adverse effect upon the welds joining the laces 37 and the top chord member 43. And since the top surface of such chord member 43 is spaced from the girder beam 53, there is no force imposed on the girder beam 53 by such chord member 43.

While the principles of the invention have been shown and described in connection with particular embodiments, it is to be understood clearly that such embodiments are exemplary and not limiting.

I claim:

1. In a mobile material handling machine having an elongate generally triangular lattice girder suspended from a girder beam which is generally lateral to the lattice girder, the lattice girder being suspended by first and second support links, each of which has an upper end and a lower end and at least one support link is pivotally pinned at an end, and wherein the girder beam is supported at an elevation by a pair of legs each having a wheel assembly, the improvement comprising:

a force transfer link extending between the support links, the force transfer link having an upper end and a lower end and wherein at least one of the ends of the force transfer link is pivotally pinned to one of said support links, whereby forces transferred between the girder beam and either leg are isolated from the lattice girder.

2. The machine of claim 1 wherein:

the upper end of the first support link is attached to the girder beam and the lower end of the first support link is attached to the lattice girder; and, the force transfer link extends between the upper end of the first support link and the lower end of the second support link.

3. The machine of claim 2 wherein the first support link, the force transfer link and the lattice girder form an open triangle.

4. The machine of claim 3 wherein the second support link, the force transfer link and the lattice girder form an open triangle.

5. The machine of claim 1 wherein:

the girder is generally triangular and has a top apex chord member; and, the apex chord member is spaced from the lattice girder beam.

6. The machine of claim 5 wherein:

the apex chord member has a box-like cross-section;

the lattice girder includes lace members attached to the apex chord member.

7. The machine of claim 6 wherein:

the lace members are attached to the apex chord member in a cluster area; and, the chord member is internally braced by reinforcing plates at the cluster area.

8. The machine of claim 5 wherein the lattice girder is supported substantially entirely by the support links and the force transfer link.

9. The machine of claim 1 wherein (a) each of the support links and the force transfer link have an upper end and a lower end, (b) at least one end of each of the links is pivotally pinned, and (c) the lattice girder is supported substantially entirely by the support links and the force transfer link.

* * * * *

UNITED STATES PATENT AND TRADEMARK OFFICE

CERTIFICATE OF CORRECTION

PATENT NO. : 5,385,249

DATED : January 31, 1995

INVENTOR(S) : Herbert D. Long, Jr.

It is certified that error appears in the above-indentified patent and that said Letters Patent is hereby corrected as shown below:

In column 6, line 65, insert --lattice-- before the word "girder".

In column 6, line 67, delete "lattice".

Signed and Sealed this

Eleventh Day of April, 1995

*Attest:*

Bruce Lehman

BRUCE LEHMAN

*Attesting Officer*

*Commissioner of Patents and Trademarks*